US009468313B2

(12) United States Patent
Kniffen

(10) Patent No.: US 9,468,313 B2
(45) Date of Patent: Oct. 18, 2016

(54) PRODUCT DISPLAY TRAY

(71) Applicant: ATA Retail Services, Inc., Pleasanton, CA (US)

(72) Inventor: Kenneth Kniffen, Tempe, AZ (US)

(73) Assignee: ATA Retail Services, Inc., Pleasanton, CA (US)

( * ) Notice: Subject to any disclaimer, the term of this patent is extended or adjusted under 35 U.S.C. 154(b) by 0 days.

(21) Appl. No.: 14/874,133

(22) Filed: Oct. 2, 2015

(65) Prior Publication Data

US 2016/0095451 A1 Apr. 7, 2016

Related U.S. Application Data

(60) Provisional application No. 62/059,779, filed on Oct. 3, 2014.

(51) Int. Cl.
*A47F 5/08* (2006.01)
*A47F 5/00* (2006.01)
(Continued)

(52) U.S. Cl.
CPC ..... *A47F 5/005* (2013.01); *A47F 3/14* (2013.01); *A47B 47/00* (2013.01); *A47B 57/06* (2013.01); *A47B 96/027* (2013.01)

(58) Field of Classification Search
CPC ..... A47F 5/005; A47F 3/14; A47B 96/027; A47B 47/00; A47B 57/06
USPC ..... 211/184, 90.01, 187, 134, 153, 126.1; 108/108, 147.11, 147.17, 60, 61; 220/529, 531, 534, 535, 543; 312/116, 312/405.1, 408, 404, 321.5
See application file for complete search history.

(56) References Cited

U.S. PATENT DOCUMENTS 568,910 A * 10/1896 Knowles ..... E06B 3/481 160/181
960,833 A * 6/1910 Crum ..... B42F 17/02 220/543

(Continued)

FOREIGN PATENT DOCUMENTS

WO WO0197660 12/2001

OTHER PUBLICATIONS

"Leaflet Display: Wave Stand with Literature Pockets," Displays2Go website, Publication Displays SKU: WVLH4518, 2014.

(Continued)

*Primary Examiner* — Joshua J Michener
*Assistant Examiner* — Devin Barnett
(74) *Attorney, Agent, or Firm* — Brian Beverly; Beeson Skinner Beverly, LLP

(57) ABSTRACT

A product display tray comprises a tray frame having a product support shelf a front support wall extending upwardly from the front edge of the support shelf and two opposing lateral support walls extending upwardly from the lateral edges of the support shelf and rearwardly from the side edges of the front support wall forming a product retaining enclosure, and attachment flanges extending outward laterally from the rear edges of the lateral support walls, the bottom surface of the support shelf including an arcuate reinforcement beam wherein the middle portion is disposed closer to the back edge of the product support shelf than the end portions thereof, and one or more dividers detachably attached to the front support wall and movable laterally for dividing the enclosure into two or more product retaining partitions.

12 Claims, 8 Drawing Sheets

(51) Int. Cl.

| | |
|---|---|
| ***A47F 3/14*** | (2006.01) |
| *A47B 96/02* | (2006.01) |
| *A47B 47/00* | (2006.01) |
| *A47B 57/06* | (2006.01) |

(56) References Cited

U.S. PATENT DOCUMENTS 1,030,317 A * 6/1912 Middaugh ..... A47B 63/00 206/449
1,037,912 A * 9/1912 Howard ..... A47B 88/20 211/51
1,500,007 A * 7/1924 Siibbald ..... A21B 3/132 206/558
1,523,136 A * 1/1925 O'Connor ..... B25H 3/06 206/558
1,587,668 A 6/1926 Mitchell
1,677,544 A * 7/1928 Gourley ..... A47B 88/20 211/184
1,906,191 A * 4/1933 Bertram ..... B65D 25/06 220/543
2,309,896 A * 2/1943 Gustafson ..... B65D 25/04 119/52.4
2,507,792 A * 5/1950 King ..... A61J 7/02 193/1
2,538,908 A * 1/1951 McKeehan ..... A47F 5/005 211/11
2,633,318 A * 3/1953 Caples ..... A45F 3/44 108/147.11
2,658,643 A * 11/1953 Miller ..... A47J 37/108 220/529
2,663,449 A * 12/1953 Smart ..... A21B 3/13 220/543
2,697,631 A * 12/1954 Miller ..... B60P 7/14 211/184
2,746,457 A * 5/1956 Musacchia ..... B42F 17/02 220/542
2,868,391 A * 1/1959 Sides ..... A47F 5/13 211/126.1
2,934,214 A * 4/1960 Mogulescu ..... A47F 5/10 211/126.12
2,982,423 A * 5/1961 Handler ..... A47F 5/0025 211/126.1
3,130,693 A * 4/1964 Shell ..... A47B 57/045 108/108
3,163,132 A * 12/1964 Nelson ..... A47B 1/04 108/108
3,285,424 A * 11/1966 Emery ..... A47F 7/145 108/60
3,331,524 A * 7/1967 Wiley, Jr. ..... A47G 7/044 211/78
3,391,816 A * 7/1968 Swett ..... A47J 47/02 220/534
3,469,543 A * 9/1969 Everett ..... A47B 96/027 108/147.17
3,469,711 A * 9/1969 Swaneck ..... A47B 57/16 108/108
3,556,306 A * 1/1971 Shell ..... A47B 96/021 108/108
3,827,377 A * 8/1974 Aughtry, Jr. ..... A47F 5/103 108/108
3,832,957 A * 9/1974 Mendenhall ..... A47B 96/025 108/108
3,893,739 A * 7/1975 Bernard ..... A47B 57/585 211/184
3,905,484 A 9/1975 Dean et al.
4,102,470 A * 7/1978 Timmons ..... B42F 17/12 211/50
4,768,661 A * 9/1988 Pfeifer ..... A47F 5/005 211/184
4,809,856 A 3/1989 Muth
4,867,329 A 9/1989 Dieter
4,962,860 A 10/1990 Lehmann
5,082,125 A * 1/1992 Ninni ..... A47F 5/0823 108/61
5,090,577 A 2/1992 Lehmann
5,101,988 A 4/1992 Meyer
5,255,802 A 10/1993 Krinke et al.
5,341,945 A * 8/1994 Gibson ..... A47F 5/005 108/60
5,395,049 A * 3/1995 Huhn ..... B42F 17/14 206/425
5,685,624 A * 11/1997 Lee ..... F25D 23/04 312/274
5,765,390 A 6/1998 Johnson et al.
5,971,173 A * 10/1999 Valiulis ..... A47F 5/005 211/184
6,186,608 B1 * 2/2001 Pink ..... F25D 23/04 312/321.5
6,231,099 B1 * 5/2001 Greenwald ..... B60R 7/06 220/531
6,401,942 B1 * 6/2002 Eckert ..... A47F 1/126 211/184
6,571,967 B2 6/2003 Belokin et al.
6,871,921 B2 * 3/2005 Ernst ..... A47B 88/20 220/529
6,923,519 B2 * 8/2005 Dallman ..... F25D 25/024 108/108
7,051,885 B2 5/2006 Belokin et al.
7,229,143 B2 * 6/2007 Gilman ..... F25D 23/04 312/319.1
7,306,106 B2 12/2007 Robertson
7,441,663 B2 10/2008 Osborn
7,913,862 B2 3/2011 Collins et al.
7,918,516 B2 * 4/2011 Decker ..... A47B 96/021 108/108
7,997,668 B2 * 8/2011 Lee ..... F25D 25/025 312/331
8,152,005 B2 4/2012 Barkdoll et al.
8,152,254 B2 * 4/2012 Kim ..... F25D 25/025 312/331
8,162,158 B2 4/2012 Northrup, Jr. et al.
8,191,719 B2 6/2012 van Ooyen et al.
8,439,462 B2 * 5/2013 Seo ..... F25D 23/04 312/321.5
8,657,132 B2 * 2/2014 Benz ..... A47B 57/586 211/184
8,668,290 B2 * 3/2014 Rotter ..... A61F 9/00772 312/311
8,720,702 B2 5/2014 Nagel
8,833,881 B2 * 9/2014 Manniso ..... A47B 88/20 211/10
8,926,034 B2 * 1/2015 Park ..... A47B 96/025 108/102
9,072,378 B2 * 7/2015 Baum ..... F25D 25/025 220/529
2003/0141265 A1 * 7/2003 Jo ..... A47F 1/126 211/59.3
2003/0189018 A1 10/2003 Hopkins et al.
2004/0238543 A1 * 12/2004 Askew ..... B65D 81/3816 220/529
2005/0067930 A1 * 3/2005 Shin ..... F25D 23/04 312/408
2007/0221103 A1 * 9/2007 Trausch ..... A47B 57/045 108/108
2008/0272078 A1 11/2008 Belokin et al.
2010/0176702 A1 * 7/2010 Kim ..... F25D 23/04 312/405.1
2010/0270902 A1 * 10/2010 Kim ..... F25D 17/042 312/405.1
2012/0286639 A1 * 11/2012 Lee ..... F25D 23/025 312/405.1
2012/0293056 A1 * 11/2012 Kim ..... A47B 96/16 312/405.1
2013/0020270 A1 * 1/2013 Valiulis ..... A47F 5/005 211/59.2
2013/0140313 A1 * 6/2013 Frankenberg ..... B65D 25/04 220/529
2014/0062283 A1 * 3/2014 Baldo ..... F25D 23/04 312/405.1
2015/0176887 A1 * 6/2015 Castro Solis ..... F25D 25/025 312/405.1
2015/0216297 A1 * 8/2015 Plikat ..... A47B 21/06 108/147.17

(56) References Cited

U.S. PATENT DOCUMENTS

2015/0247666 A1* 9/2015 Kim ..... F25D 23/04
312/404
2015/0330700 A1* 11/2015 Celik ..... F25D 23/04
312/405.1
2016/0131413 A1* 5/2016 Im ..... F25D 23/02
312/405.1
2016/0138855 A1* 5/2016 Choo ..... F25D 23/04
312/405.1

OTHER PUBLICATIONS

Display Technologies Product Description, website, 2013.

* cited by examiner

PRODUCT DISPLAY TRAY

CROSS-REFERENCE TO RELATED APPLICATIONS

This application claims the benefit of U.S. Provisional Application No. 62/059,779 filed Oct. 3, 2014.

BACKGROUND

1. Field of the Invention

The invention is directed to product display shelves and particularly to product display trays detachably secured to the front panel of a product display case.

2. Description of the Prior Art

Product display trays that are detachably secured to the inside or the outside surface of the usually transparent viewing panel of an access door of a product display case have come into widespread use. Such display trays take advantage of the relatively large surface area created by the viewing panels of such access doors for displaying products at eye level where they are within easy reach of the consumer. The display trays are typically attached to the viewing panel using detachable fasteners such as suction cups. This arrangement is relatively effective for retaining the display tray on the viewing panel, even when subjected to inertial forces created when opening and closing the access door, and even while carrying the weight of products loaded on the tray.

One disadvantage of prior art display trays is that each display tray has a defined width which prevents making adjustments in the width of the tray to accommodate different product sizes. An associated problem is that, if less than the maximum number of products are loaded onto a display tray, the products on the tray may shift from side-to-side as the access door is opened and closed which may cause the products to fall off the tray, dislodge the tray from the access door, or at very least cause the products to present in a state of disarray.

Some prior art product display trays have attempted to address this problem by installing static dividers in the floor of the display tray. Another solution has been to scallop the horizontal back wall of the display tray to partially compartmentalize the tray. While useful innovations, each of these improvements provides a display tray that is useful for only one product size and cannot be adjusted to accommodate products of different sizes.

Another disadvantage of prior art display trays is that some employ a support wall located at an edge of the display shelf which may have advertising indicia that interferes with visibility of products in the display case. It is desirable in a detachable product display tray to minimize the profile of the tray in order to maximize visibility of the products being displayed in the tray and to minimize visual obstruction of products stocked in the display case.

SUMMARY OF THE INVENTION

A product display tray according to the invention comprises a product support shelf bounded on one edge by an upwardly extending vertical retaining wall having an outwardly curved upper edge. One or more dividers removably attached to the curved upper edge are movable laterally along the retaining wall thereby permitting the display space on the support shelf to be adjusted according to product size and providing a lateral support guarding against unwanted product shifting caused by opening and closing of the display case access door.

An arcuate support rib is integrated into the product support shelf to undergird the support shelf. The rib is curved so that the middle portion thereof approaches the free front edge of the support shelf more closely than the end portions thereof thereby increasingly reinforcing the shelf in the middle portion where it is most needed in an aesthetically pleasing presentation that minimizes visual obstruction of the contents of the display case.

DETAILED DESCRIPTION OF THE ILLUSTRATED EMBODIMENTS

Figure 1:
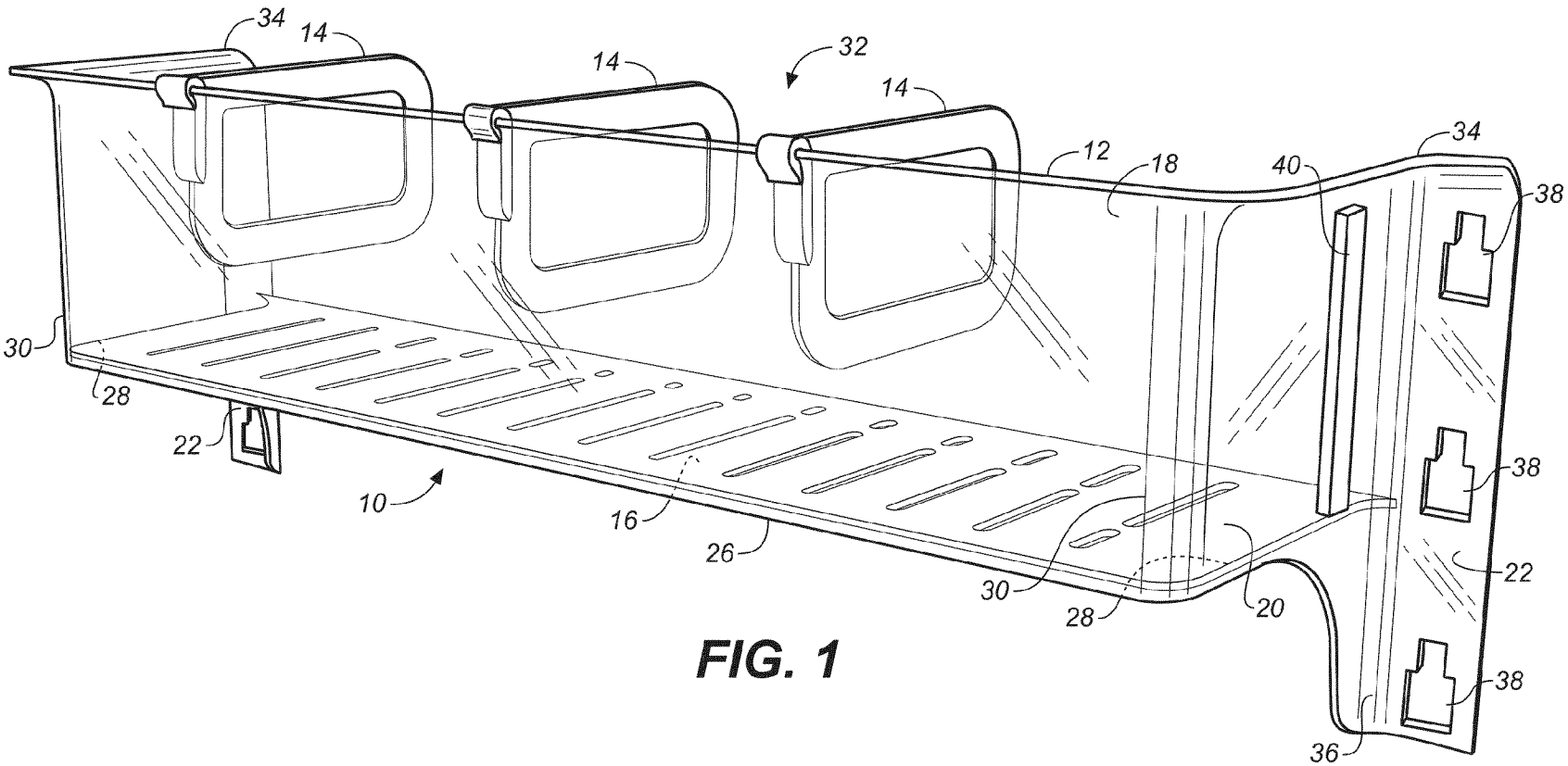
FIG. 1 is an upper front perspective view of a product display tray according to the invention.
Figure 2:
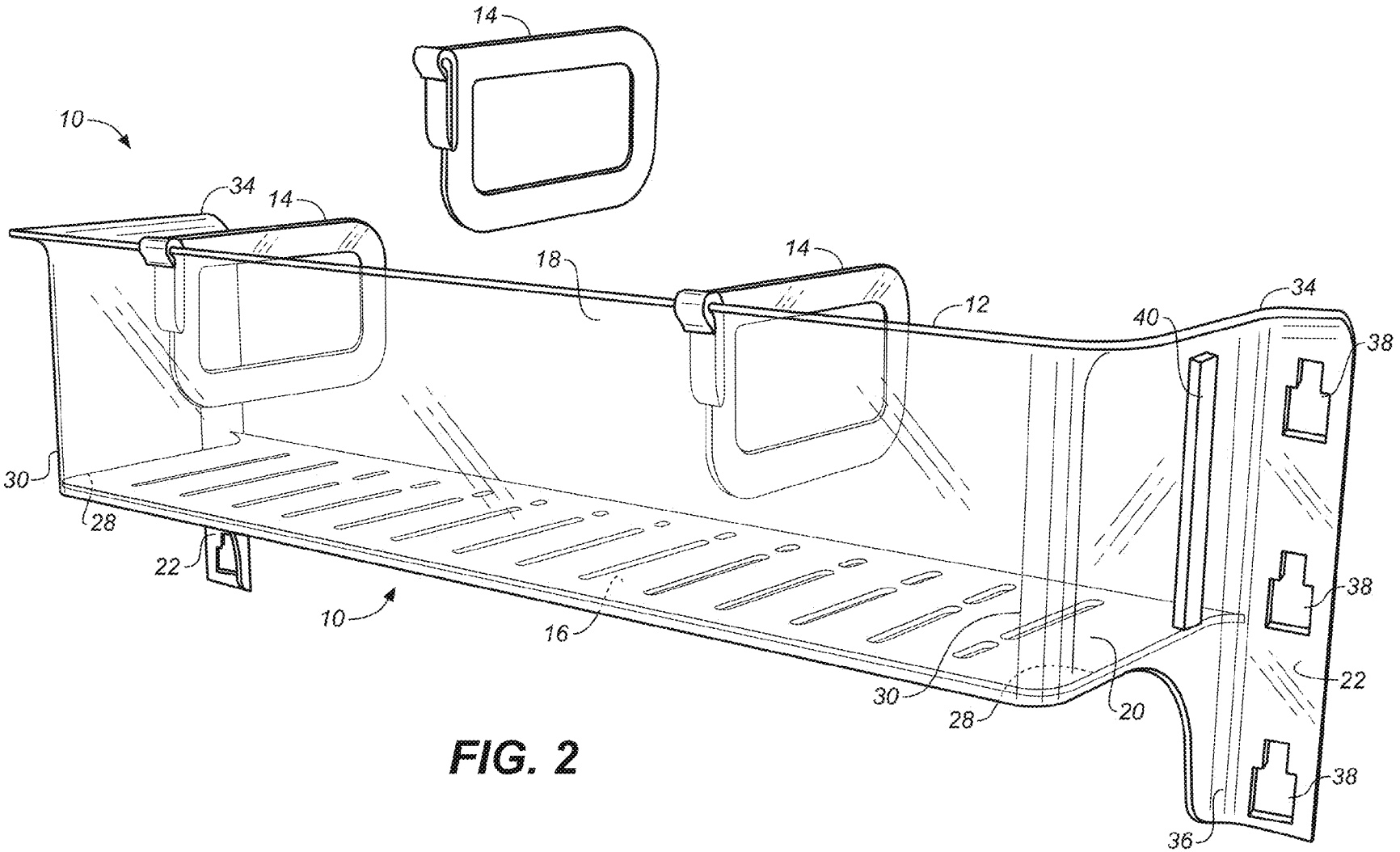
FIG. 2 is an exploded upper front perspective view thereof.
Figure 3:
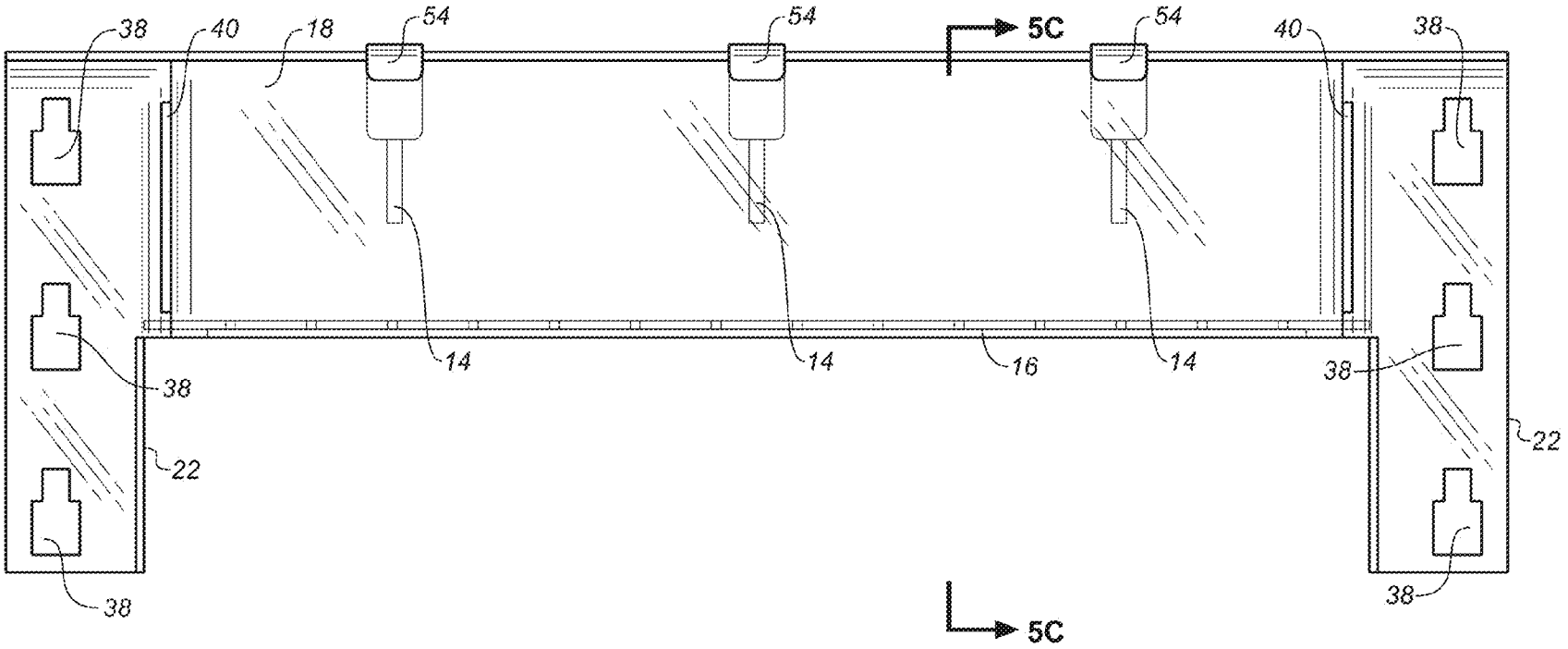
FIG. 3 is a front elevation view thereof.

A product display tray according to the invention is referred to generally at numeral 10 in FIG. 1. The product display tray comprises a unitary tray frame 12 and one or more dividers 14. The tray frame 12 comprises a product support shelf 16, front support wall 18, opposing lateral support walls 20, and attachment flanges 22. The support shelf 16 has a free-floating back edge 24, a front edge 26 opposite the back edge 24, and opposing lateral edges 28. The front support wall 18 extends upwardly from the front edge 26 of the support shelf 16 and the lateral support walls 20 extend upwardly from the lateral edges 28 of the support shelf 16 and rearwardly from the side edges 30 of front support wall 18. Front and lateral support walls 18, 20 thus surround the support shelf 16 to form three sides of an enclosure 32 for retaining products placed on the support shelf 18.

Figure 6:
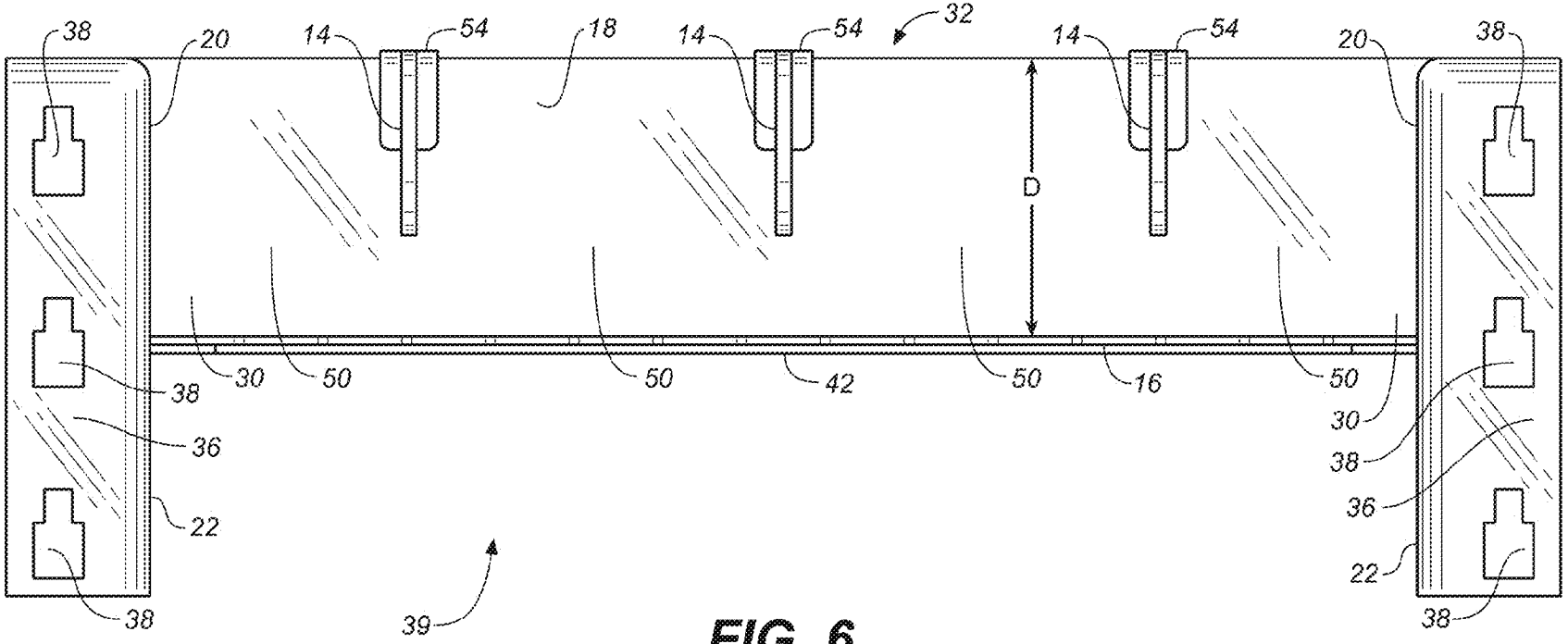
FIG. 6 is a rear elevation view of the product display tray.

With additional reference to FIGS. 6-8, it can been seen that attachment flanges 22 extend laterally from the rear edges 34 of lateral support walls 20 and that a lower portion 36 of each attachment flange 22 extends below and laterally of support shelf 16. Each attachment flange 22 includes one or more fastener-receiving apertures 38 into which the attachment head of a fastener such as a suction cup (not shown) can be inserted and secured. The attachment flanges 22 and the back edge 24 of the support shelf 16 are disposed in a common plane such that, when the attachment flanges 22 are secured to a surface such as a product display case door, the back edge 24 is positioned adjacent to the surface of the door which thereby forms the fourth side of and completes the product retaining enclosure 32. Although in the illustrated embodiment, each attachment flange 22 includes three fastener-receiving apertures 38, the flange 22 could include one or more apertures depending on space and aesthetic considerations, and the number of fasteners deemed appropriate for the intended use of the tray. It can also be seen that the lower portions 36 of attachment flanges 22 and support shelf 16 defined the boundaries of an unobstructed viewing area 39 that improves visibility of products stocked in a display case behind the product display tray.

In the illustrated embodiment, each lateral support wall 20 includes a vertically-extending reinforcing bead 40 for providing added vertical strength and rigidity along the forward edge of each wall 20. It will be appreciated that the reinforcing bead 40 is optional depending on the strength of the material constituting the lateral support walls 20.

Figure 7:
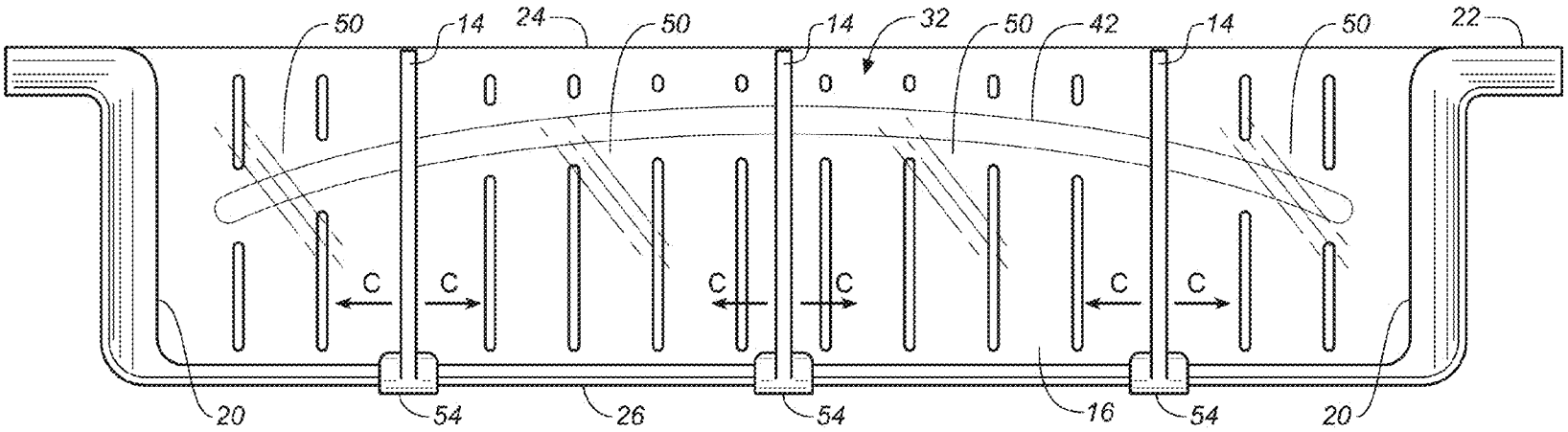
FIG. 7 is a top plan view thereof.
Figure 8:
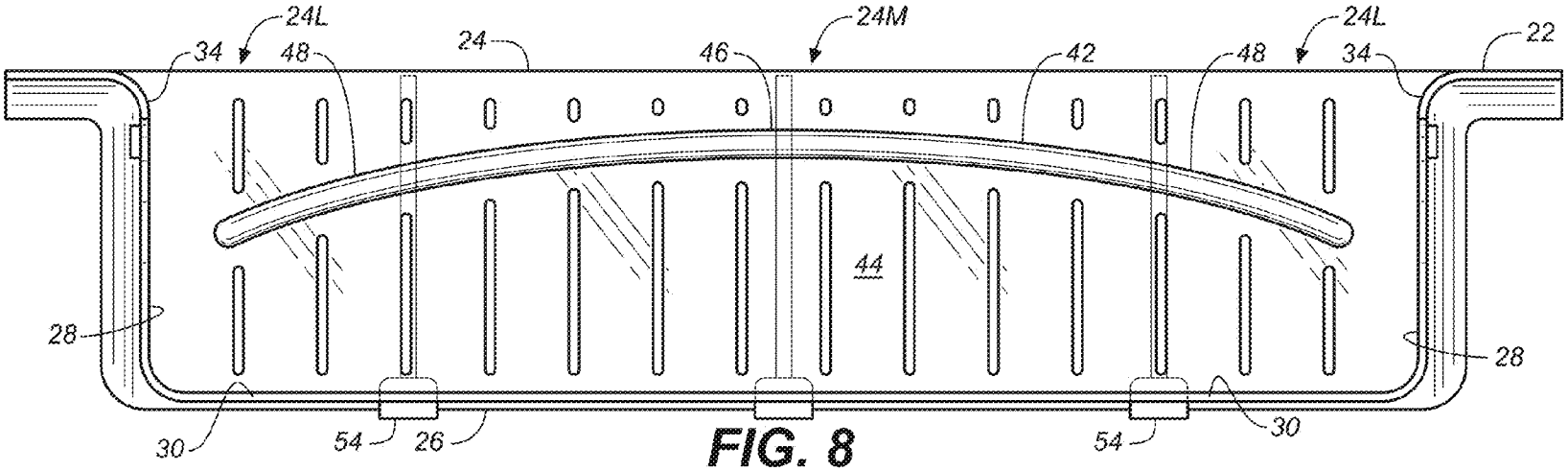
FIG. 8 is a bottom plan view thereof.

With particular reference now to FIGS. 7 and 8, it is seen that an arcuate reinforcement beam 42 extends along the bottom surface 44 of support shelf 16. Reinforcement beam 42 provides added strength along the lateral dimension of support shelf 16 and therefore spans substantially the entire lateral extent of support shelf 16 as shown. Beam 42 is curved such that the middle portion 46 thereof is disposed closer to the back edge 24 of support shelf 16 than the two opposite end portions 48 thereof. In the illustrated embodiment, the beam 42 has a thickness not substantially greater than the thickness of the product support shelf 16, but the beam could be thicker as may be appropriate if it is intended that the shelf hold heavier products. The reinforcement beam 42 advantageously provides greater support to the mid-portion 24M than to the lateral edges 24L of the back edge 24 of support shelf 16 where it is most needed, while presenting an aesthetically attractive appearance and an unobtrusive low profile.

Figure 4:
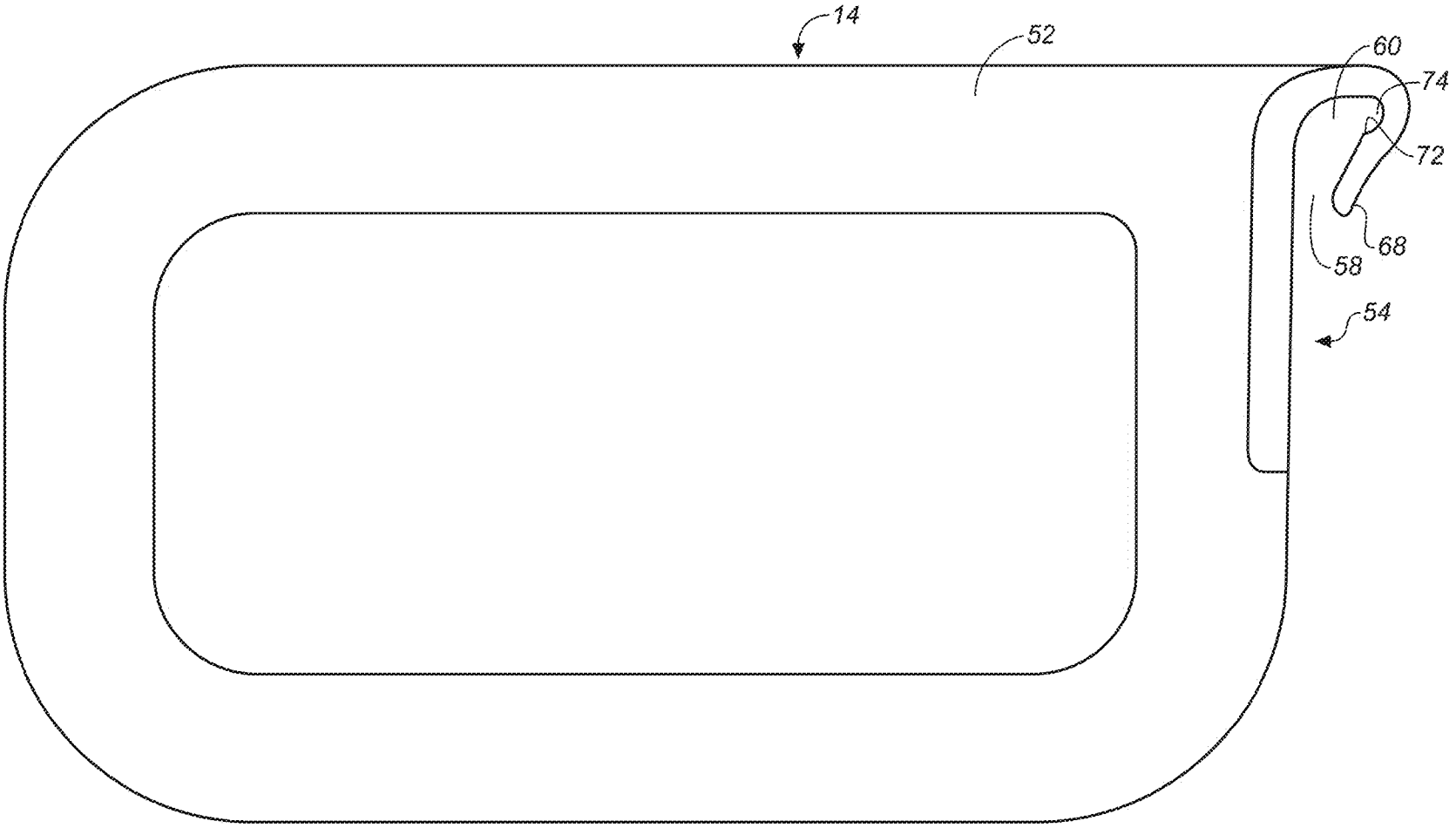
FIG. 4 is an enlarged view of one of the dividers of the product display tray.

As shown in FIGS. 1-3 and 6, one or more dividers 14 may be detachably positioned along front support wall 18 in order to separate the enclosure 32 into two or more product retaining partitions 50. In FIG. 4 it is seen that each divider 14 includes a dividing panel 52 that extends across substantially the entire horizontal depth D of the product retaining enclosure. An attachment clip 54 is provided on one corner of the dividing panel 52. Clip 54 is curved back on itself to form an opening 58 leading to curved retention slot 60. Slot 60 is shaped to conform to the outward curved profile of the support wall's upper edge 56 (see again FIGS. 5A-5D).

Figure 5C:
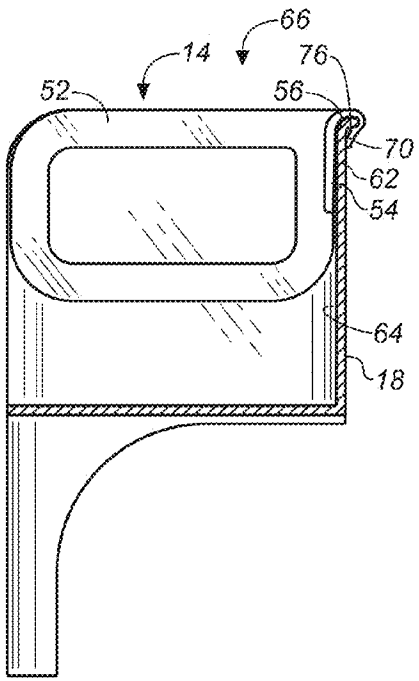
FIG. 5C is a side sectional view of the product display tray similar to FIGS. 5A-5B showing a divider in an attached position on the tray.
Figure 5B:
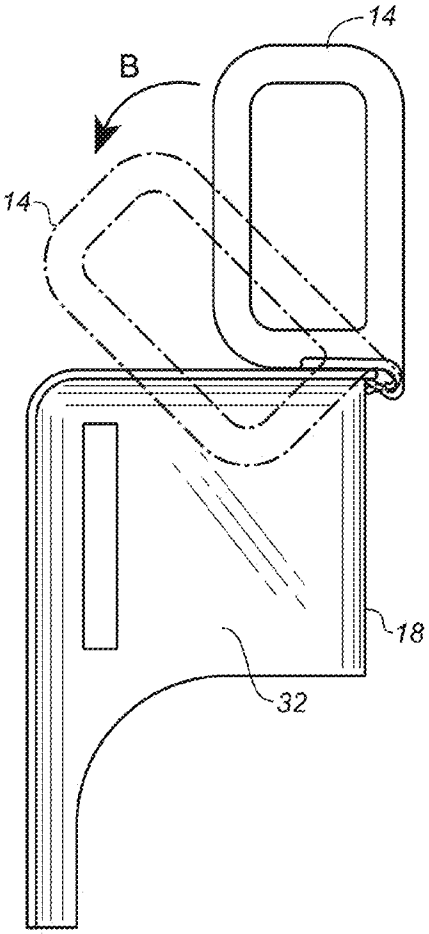
FIGS. 5A-5B are exploded side elevation views thereof showing a divider being installed on the tray.
Figure 5A:
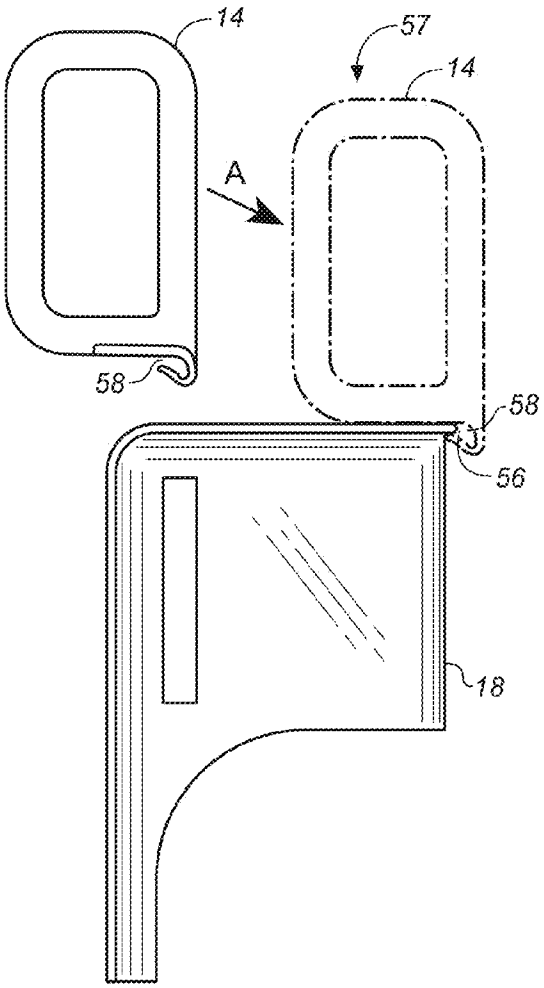
Figure 5D:
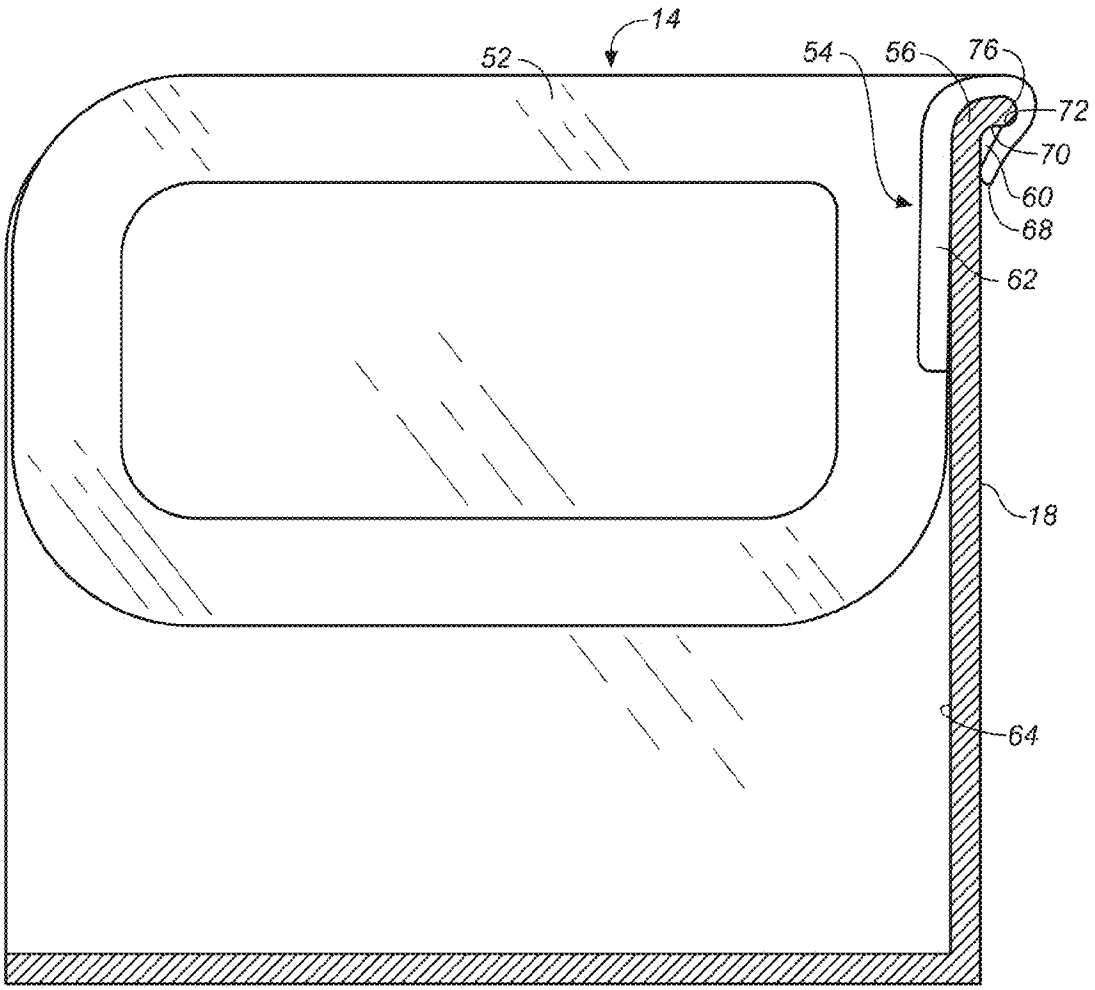
FIG. 5D is an enlarged sectional view of the divider and a portion of the tray showing the divider in the attached position.

Divider 14 is attached to front support wall 18 by placing it as shown by arrow A in FIG. 5A in a ready position 57 with opening 58 poised at the upper edge 56 of wall 18. Swivelling divider 14 downwards into enclosure 32, as shown by arrow B in FIG. 5B, inserts the upper edge 56 of wall 18 through opening 58 into slot 60. In the attached position 66 seen in FIG. 5C and, in the enlarged view shown in FIG. 5D, clip body 62 abuts the vertical face 64 of front support wall 18 and finger 68 of clip 54 is tucked under the overhanging horizontal rim 70 of the upper edge 56 of front support wall 18, thereby preventing the divider from accidentally being removed upwardly from wall 18.

With additional reference to FIG. 4, it is seen that ridge 72 on the inner surface of slot 60 forms a pocket 74 in the upper end of slot 60. In the attached position 66 shown in FIG. 5D, the free end 76 of upper edge 56 fits snugly in pocket 74 with ridge 72 in contact with the underside of rim 70, such that the downward pull of gravity on divider panel 52 tends to secure clip 54 about the upper edge 56 of front support wall 18 and seats end 76 in pocket 74 which also prevents further downward rotation of divider 14.

When the selected number of dividers 14 have been attached to front support wall 18, they can be slid laterally, as indicated by arrows C in FIG. 7, to form variable width partitions 50 sized as needed to conform to the dimensions of products to be displayed on the tray.

A product display tray according to the invention includes one or more dividers detachably attachable to the back support wall of the tray which can be moved laterally along the tray to form adjustable width partitions sized to conform to the products to be displayed on the tray. An integrated curved support beam provides structural reinforcement for the support shelf, is aesthetically pleasing and gives the support shelf an unobtrusive low profile.

There have thus been described and illustrated certain embodiments of a product display tray according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

I claim:

1. A product display tray comprising:

a tray frame having a product support shelf having a front edge, a back edge opposite said front edge, and opposite lateral edges, a front support wall extending upwardly from said front edge, two opposing lateral support walls extending upwardly from said lateral edges, fastening flanges extending generally perpendicular from said lateral support walls, the fastening flanges each having apertures configured to receive fasteners for attaching said tray frame to a vertical surface, and a product retaining enclosure bounded by said front and lateral support walls; wherein the back edge of said support shelf includes a mid-portion and two opposite lateral edges, and said product support shelf includes a bottom surface having an arcuate reinforcement beam extending substantially the entire lateral dimension of said support shelf, said beam having two opposite end portions and a middle portion, said middle portion disposed closer to the back edge of said product support shelf than said end portions, whereby said reinforcement beam provides greater support to the mid-portion of the back edge of said support shelf than to the lateral edges thereof.

2. The product display tray of claim 1 wherein:

each of the two opposite end portions of said reinforcement beam are spaced inwardly from the lateral edges of said support shelf.

3. The product display tray of claim 1 wherein:

said reinforcement beam has a thickness not substantially greater than a thickness of said product support shelf.

4. The product display tray of claim 1 wherein:

each of said lateral support walls has a rear edge, and said fastening flanges comprise opposing fastening flanges each extending outward laterally from the rear edge of one of said lateral support walls, said fastening flanges in planar alignment with the back edge of said support shelf.

5. The product display tray of claim 4 wherein:

each of said fastening flanges includes a lower portion that extends below said support shelf, the lower portion of said fastening flanges and said support shelf bounding an unobstructed horizontal viewing area.

6. The product display tray of claim 1 wherein:

each of said lateral support walls has a rear edge, and each of said lateral support walls has a vertically-extending reinforcement bead disposed closer to the rear edge thereof than to said front support wall.

7. The product display tray of claim 1 wherein:

said product retaining disclosure includes a depth defined by said front support wall and a vertical plane including the back edge of said support surface, and said support wall has an outwardly curved upper edge, and said product display tray further comprises one or more dividers, each of said one or more dividers including a dividing panel and an attachment clip, said dividing panel extending from said attachment clip across substantially the entire depth of said product retaining disclosure, said attachment clip detachably attached to the upper edge of said support wall and movable laterally there along for adjusting the position of said dividing panel in said product retaining enclosure and for dividing said enclosure into two or more product retaining partitions.

8. The product display tray of claim 7 wherein:

the outwardly curved upper edge of said support wall includes a free end forming an overhanging horizontal rim, and said clip includes a clip body and an attachment lip extending from said clip body and curled over and back toward said clip body to form a retention slot conforming to the shape of the upper edge of said support wall, said attachment lip having a curled-under terminal edge, said slot having a downwardly oriented opening sized for closely receiving said support wall, said clip movable between a ready position and an attached position, in said ready position said clip body is spaced from said support wall and the free end of the upper edge of said support wall is positioned in the opening to said slot, and in said attached position said clip body is in abutting engagement with said support wall, the upper edge of said support wall is captured in said retention slot, and the terminal edge of said attachment lip is tucked under the free end of said upper edge and in sliding abutment with said support wall, thereby securing the attachment lip of the clip of said divider on the upper edge of said support wall.

9. The product display tray of claim 8 wherein:

said attachment lip includes an inner surface having a ridge, said ridge forming a pocket in the upper end of said retention slot, wherein when said clip is in said attached position the free end of said support wall is closely captured in said pocket and said ridge is abutting the underside of said horizontal rim, thereby locking said attachment clip against upward movement relative to said support wall.

10. A product display tray comprising:

a tray frame having a product support shelf having a front edge, a back edge opposite said front edge, opposite lateral edges, and a bottom surface, said back edge including a mid-portion and two opposite lateral edges, a front support wall extending upwardly from said front edge, two opposing lateral support walls extending upwardly from said lateral edges, fastening flanges extending generally perpendicular from said lateral support walls the fastening flanges each having apertures configured to receive fasteners for attaching said tray frame to a vertical surface, and a product retaining enclosure bounded by said front and lateral support walls, and one or more dividers detachably attached to said front support wall and movable laterally there along for dividing said enclosure into two or more product retaining partitions, the bottom surface of said product support shelf having a continuous reinforcement beam extending substantially the entire lateral dimension of said support shelf and having two opposite end portions and a middle portion, each of said end portions spaced inwardly from the lateral edges of said support shelf, said middle portion disposed closer to the back edge of said product support shelf than said end portions, whereby said reinforcement beam provides greater support to the mid-portion of the back edge of said support shelf than to the lateral edges thereof.

11. A product display tray comprising:

a tray frame having a product support shelf including a front edge, a back edge opposite said front edge, opposite lateral edges, and a bottom surface, said back edge including a mid-portion and two opposite lateral edges, said product support shelf including a bottom surface having an arcuate reinforcement beam, said beam extending substantially the entire lateral dimension of said support shelf and having two opposite end portions and a middle portion, each of said end portions spaced inwardly from the lateral edges of said support shelf, said middle portion disposed closer to the back edge of said product support shelf than said end portions to provide greater support to the mid-portion of the back edge of said support shelf than to the lateral edges thereof, a front support wall extending upwardly from said front edge, said support wall having an outwardly curved upper edge, two opposing lateral support walls extending upwardly from said lateral edges, fastening flanges extending from said lateral support walls for attaching said tray frame to a vertical surface, and a product retaining enclosure bounded by said front and lateral support walls, said product retaining disclosure including a horizontal depth defined by said front support wall and a vertical plane including the back edge of said support surface, and one or more dividers detachably attached to said front support wall and movable laterally there along for dividing said enclosure into two or more product retaining partitions, each of said one or more dividers including a dividing panel and an attachment clip, said dividing panel extending from said attachment clip across substantially the entire depth of said product retaining disclosure, said clip including a clip body and an attachment lip extending from said clip body and curled over and back toward said clip body to form a retention slot, said retention slot conforming to the shape of the upper edge of said support wall, said attachment lip having a curled-under terminal edge, said slot having a downwardly oriented opening sized for closely receiving said support wall, said divider attachable to said front support wall by moving said divider between a ready position and an attached position, in said ready position said clip body is spaced from said support wall and the free end of the upper edge of said support wall is positioned in the opening to said slot, and in said attached position said clip body is in abutting engagement with said support wall, the upper edge of said support wall is captured in said retention slot, and the terminal edge of said attachment lip is tucked under the free end of said upper edge and in sliding abutment with said support wall, thereby securing the attachment lip of the clip of said divider on the upper edge of said support wall and so that said divider is laterally movable along said support wall for adjusting the position of said dividing panel in said product retaining enclosure.

12. The product display tray of claim 11 wherein:

said attachment lip includes an inner surface having a ridge, said ridge forming a pocket in the upper end of said retention slot, wherein when said clip is in said attached position the free end of said support wall is closely captured in said pocket and said ridge is abutting the underside of said horizontal rim, thereby locking said attachment clip against upward movement relative to said support wall.

* * * * *